US005190450A

United States Patent [19]

Ghosh et al.

[11] Patent Number: 5,190,450

[45] Date of Patent: Mar. 2, 1993

[54] GEAR PUMP FOR HIGH VISCOSITY MATERIALS

[75] Inventors: Syamal K. Ghosh, Rochester; William A. Cox, Scottsville; Larry H. Bowerman, Canandaigua; David P. Stoklosa, Rochester, all of N.Y.

[73] Assignee: Eastman Kodak Company, Rochester, N.Y.

[21] Appl. No.: 847,257

[22] Filed: Mar. 6, 1992

[51] Int. Cl.[5] ..... F01C 21/02

[52] U.S. Cl. ..... 418/189; 418/98; 418/102; 384/114; 384/118

[58] Field of Search ..... 418/189, 98, 102, 132, 418/133, 178, 179; 384/114, 118, 291

[56] References Cited

U.S. PATENT DOCUMENTS

| | | | |
|---|---|---|---|
| 2,891,483 | 6/1959 | Murray et al. | 384/291 |
| 2,975,718 | 3/1961 | Hodgson | 418/189 |
| 3,053,589 | 9/1962 | Cameron | 384/118 |
| 3,690,793 | 9/1972 | Pollman | 418/102 |
| 3,711,171 | 1/1973 | Orkin et al. | 308/241 |
| 3,817,665 | 6/1974 | Myers | 418/189 |
| 3,929,396 | 12/1975 | Orkin et al. | 308/241 |
| 4,130,383 | 12/1978 | Moinuddin | 418/189 |
| 4,329,128 | 5/1982 | Forgues | 418/83 |
| 4,516,915 | 5/1985 | Jensen et al. | 417/365 |
| 4,754,181 | 6/1988 | Mizobuchi | 417/353 |
| 4,792,244 | 12/1988 | Yamashita et al. | 384/492 |
| 4,806,080 | 2/1989 | Mizobuchi et al. | 417/353 |
| 4,859,161 | 8/1989 | Teruyama et al. | 418/102 |
| 4,874,300 | 10/1989 | Laing et al. | 411/420 |
| 4,913,619 | 4/1991 | Haentjens et al. | 415/172.1 |
| 4,944,609 | 7/1990 | Salter, Jr. et al. | 384/118 |
| 5,054,940 | 10/1991 | Momose et al. | 384/193 |

*Primary Examiner*—Richard A. Bertsch
*Assistant Examiner*—Charles G. Freay
*Attorney, Agent, or Firm*—Clyde E. Bailey

[57] ABSTRACT

A pump 10 for materials having a viscosity up to about $3.0\times10^5$ cps, such as cellulose acetate, has a pump body 12 formed with a gear receiving means and, mounted thereon for closing the gear receiving means 13, a pair of side plates 16, 18 having bearing receiving cavities 21. The side plates 16, 18 have pressure relief means 50 for relieving pressure that builds-up in the intermesh of gears 14 when highly viscous material, such as cellulose acetate, is being pumped. This means of diverting the pressure buildup enables the pump 10 and component parts, such as shafts 22, 24 and plain bearings 20, to resist premature failure due otherwise to the resultant load caused by residual pressure buildup. In the preferred embodiment, wear resistant ceramic plain bearings 20 are press fitted in the bearing cavities. Grooves or channels 30 in the interior walls 32 of bearings 20 provide a means to lubricate shafts 22, 24 rotatably supported in the bearings 20. Wear resistant coatings, such as, thermally sprayed tungsten carbide, are coated on the shafts 22, 24 and surface 46 of side plate 16, 18 to promote wearability and increased life of the apparatus 10.

10 Claims, 4 Drawing Sheets

GEAR PUMP FOR HIGH VISCOSITY MATERIALS

FIELD OF THE INVENTION

The invention relates generally to transporting materials and, more particularly, to a pump for high viscosity materials used in the manufacture of photographic film base.

BACKGROUND OF THE INVENTION

Apparatus for transporting or pumping materials are well known in the art. Conventional gear pumps are typically constructed in a manner as shown in FIG. 1. Such pumps include a pump body 1 having an inlet and outlet end (not shown), a pair of herringbone gears 2 & 3, a pair of side plates 4 & 5, two internal double roller bearings 6 mounted on each of the side plates 4 & 5 (FIG. 2) and two gear support shafts 7 & 8 mounted for rotation in bearings 6. These pumps are particularly well suited for pumping, for example crude oils, and other materials having a viscosity up to about $1.0\times10^5$ centipoise (cps).

An earlier pump for materials having a viscosity up to about $1.0\times10^5$ cps is disclosed and illustrated in U.S. Pat. No. 4,859,161. The pump uses double roller bearings mounted on rotational side plates which enables the rotation of the pump to vary without changing the structure of the pump. Other pumps that use some sort of gear arrangement are disclosed in U.S. Pat. Nos. 4,329,128 and 4,806,080. In each of these prior art pumps, only low viscosity materials can be pumped because there are no means of reducing the pressure buildup in the pump housing, and particularly, reducing the load on the shaft and bearing assembly. Thus, severe premature pump and/or component part wear would result if these pumps were used to transport materials having viscosities very much greater than $1.0\times10^5$ cps.

Accordingly, a major shortcoming of earlier pumps is that they are not adapted for transporting materials having viscosities greater than about $1.0\times 10^5$ cps. Much beyond this viscosity, the integrity of the pump components is severely compromised. The life of gear pump bearings, for example, depends primarily on the load on the bearing and shaft assembly, discharge pressure, liquid viscosity, and proper alignment of the components like shafts and bushings and, to a lesser extent, on the speed and operating temperature. Thus, in order to transport highly viscous materials, e.g., cellulose acetate with a viscosity of about $3.0\times10^5$ cps, it is crucial that the wear rates of the bearings and associated components of the apparatus are minimized. Moreover, the excessive wear of the conventional double roller bearings used in conventional pumps leads to the wear and misalignment of the gear assembly and wear of the side plates that support the bearings. These component compromises, particularly at high shaft/bearing assembly loads caused by pumping high viscosity materials, result in an eventual catastrophic failure of the conventional pump.

Therefore, a need exists for a pump to transport highly viscous materials, such as cellulose acetate, which will not be subject to the high wear rates and severe failures of conventional pumps.

SUMMARY OF THE INVENTION

It is, therefore, an object of the invention to provide gear pumps for high viscosity materials which overcome the shortcomings of the prior art.

Accordingly, for accomplishing these and other objects of the invention, there is provided a pump for transporting materials having a viscosity up to about $3.0\times10^5$ cps comprising a pump body formed with a gear receiving means and having an inlet end and a discharge end. A pair of intermeshing gears are arranged in the gear receiving means in a manner to form an inlet side and a discharge side, each side being correspondingly spatially related to the inlet and discharge ends, respectively, of the pump body. A pair of side plates having bearing receiving means are mountable to the pump body. A pair of plain bearing means is press fitted in the bearing receiving means. Moreover, means are formed in the side plates for relieving pressure buildup in the intermesh of gears as material is transported towards the discharge end of the pump body thereby reducing the load on the shaft/bearing assembly and, hence, extending the service life of the assembly.

Accordingly, an important advantage of the apparatus is that highly viscous materials, such as cellulose acetate having a viscosity of $3.0\times10^5$ cps, can be transported without jeopardizing the integrity of the pump.

BRIEF DESCRIPTION OF THE DRAWINGS

The foregoing as well as other objects, features and advantages of this invention will become more apparent from the following detailed description when taken in conjunction with the appended figures in which FIGS. 1 and 2 illustrate a conventional gear pump, wherein FIG. 1 is a side view of the prior art pump and FIG. 2 is a fragmented section view along the 2—2 line of FIG. 1;

DETAILED DESCRIPTION OF THE INVENTION

Figure 1:
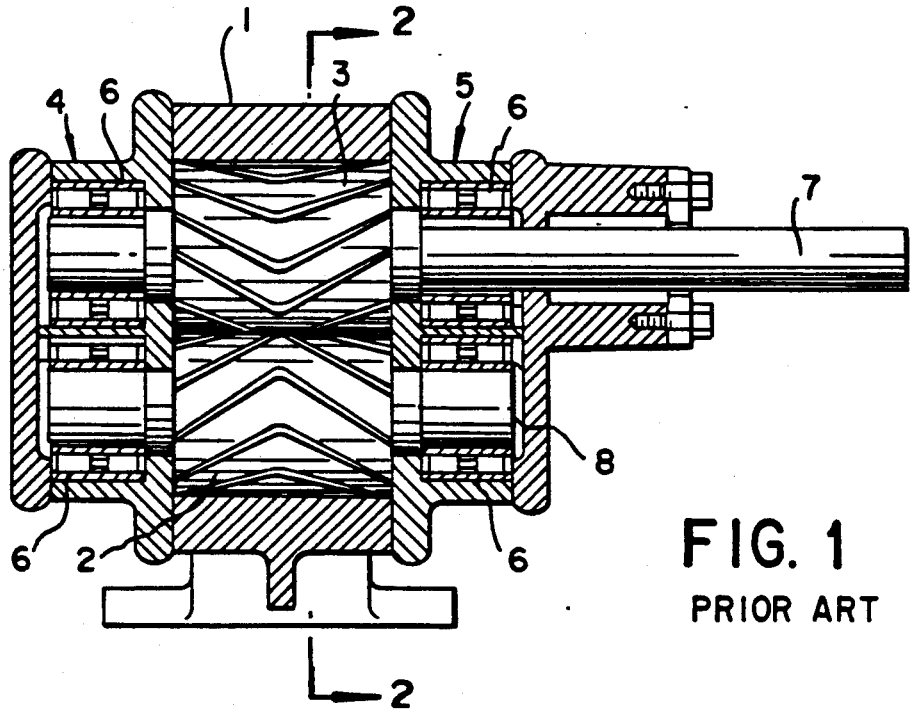
FIG. 1 PRIOR ART
Figure 3:
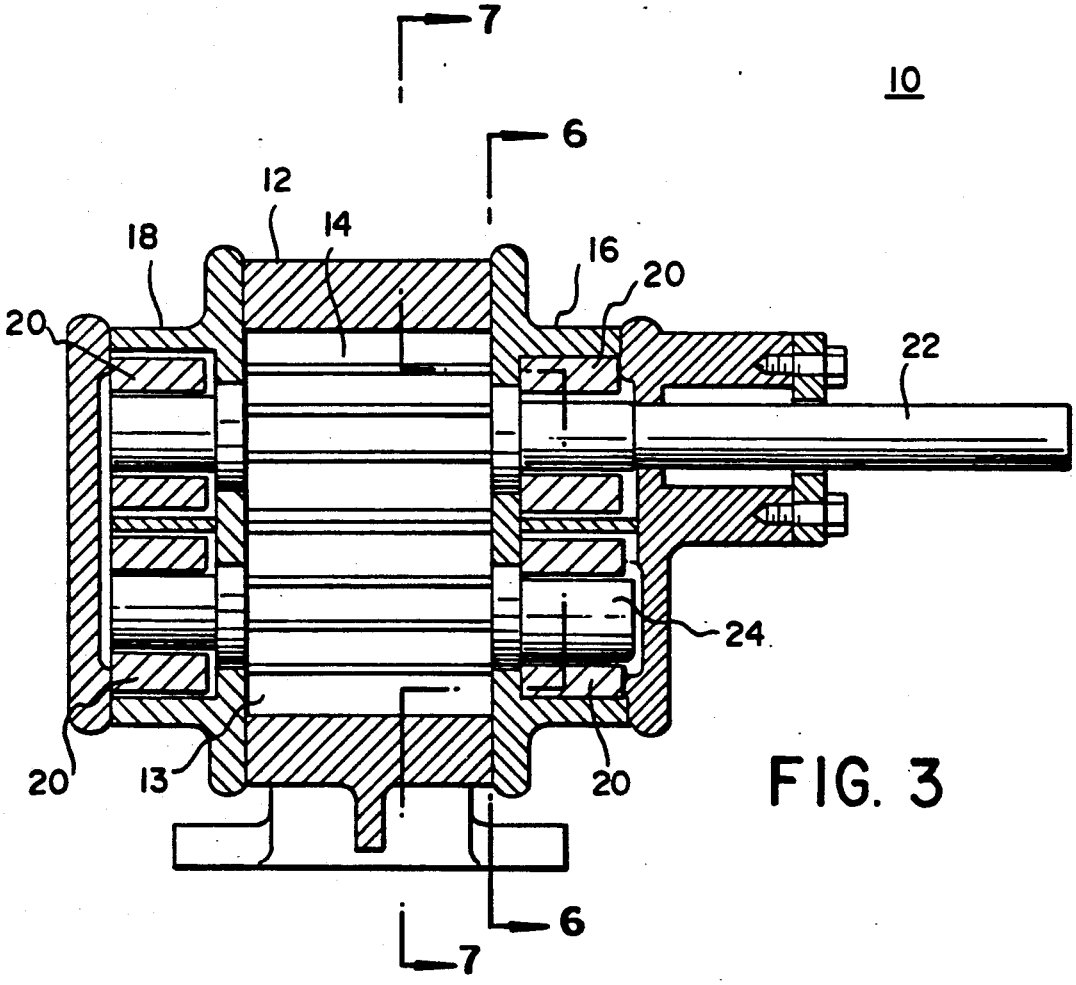
FIG. 3 is a side view of the pump of the invention.
Figure 2:
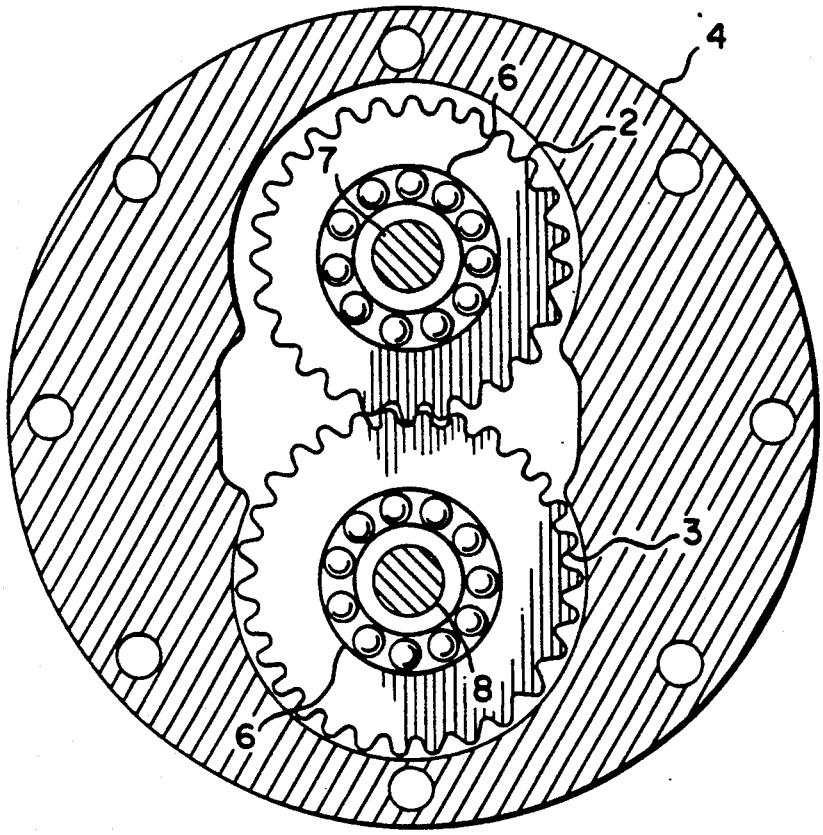
FIG. 2 PRIOR ART
Figure 6:
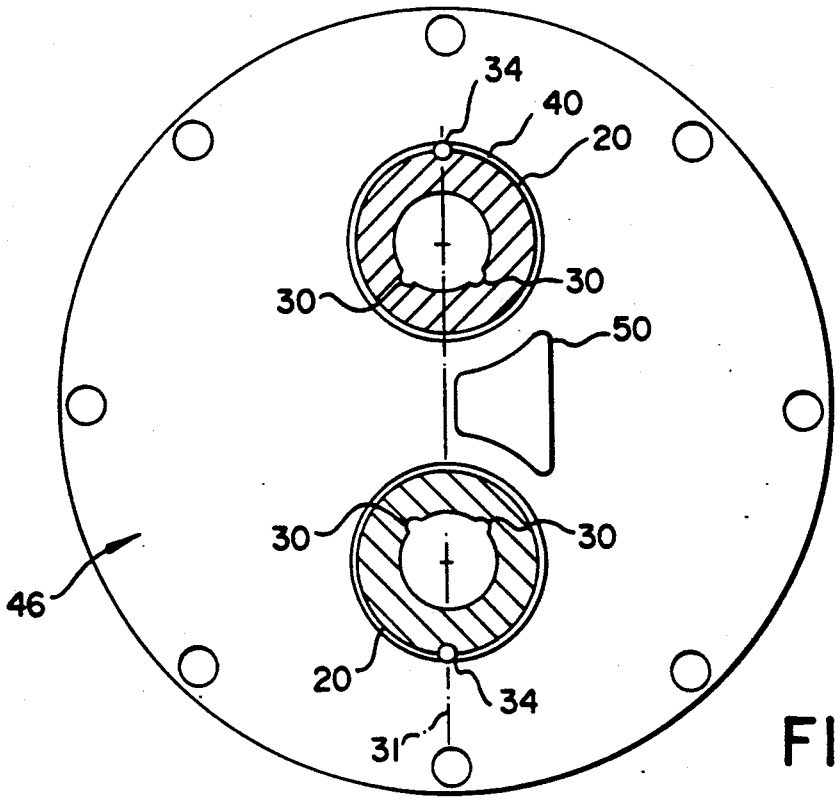
FIG. 6 is a partial section view along the 6—6 line of FIG. 3 wherein the shafts are omitted and the bearings moved into the plane of view for purposes of illustration; and, FIG. 7 is a section view along the 7—7 line of FIG. 3.
Figure 7:
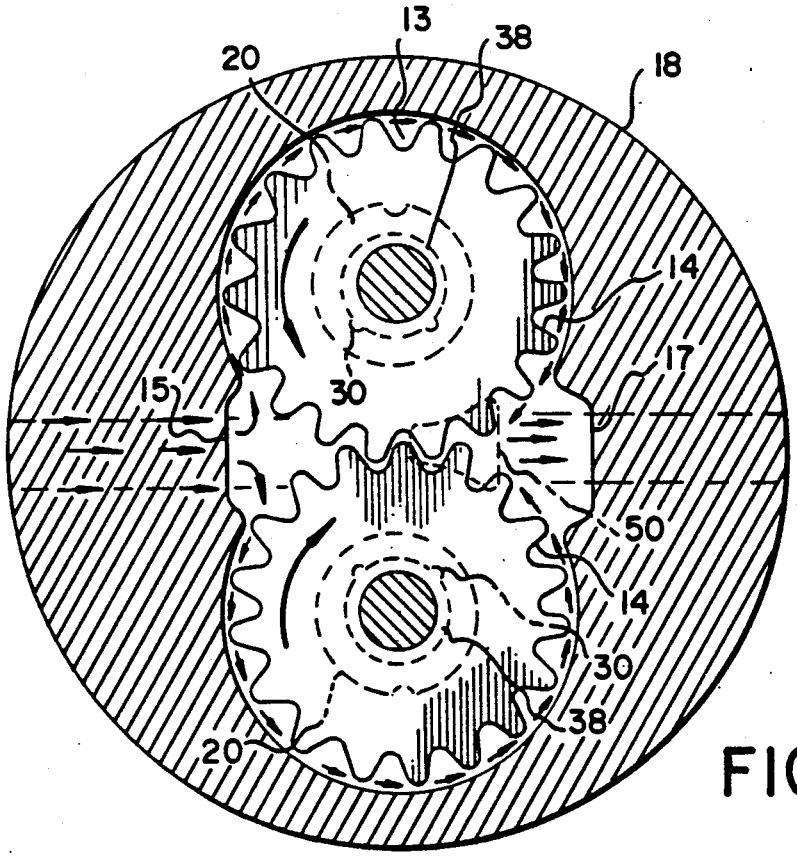

Turning now to the drawings and more particularly to FIG. 3, there is shown a pump for materials having a viscosity up to about $3.0\times10^5$ cps, such as cellulose acetate, in accordance with the principles of the invention. The pump, generally designated 10, comprises a pump body 12 having a gear receiving cavity 13 and an inlet end and a discharge end (not shown). Gear receiving cavity 13 has arranged therein a pair of intermeshing gears 14 between the inlet end and the discharge end of pump body 12 (FIG. 7). Intermeshing gears 14 form an inlet side 15 and a discharge side 17, each corresponding to the inlet and discharge ends, respectively, of pump body 12 (FIG. 7). A pair of similar right and left handed side plates 16,18 each having cavities 21 (FIG. 6) for receiving a pair of plain bearings 20 is mounted to either end of pump body 12 to close the gear receiving cavity 13. Plain bearings 20 in each side plate 16,18 support a driven gear shaft 22 and a driving shaft 24.

Figure 4:
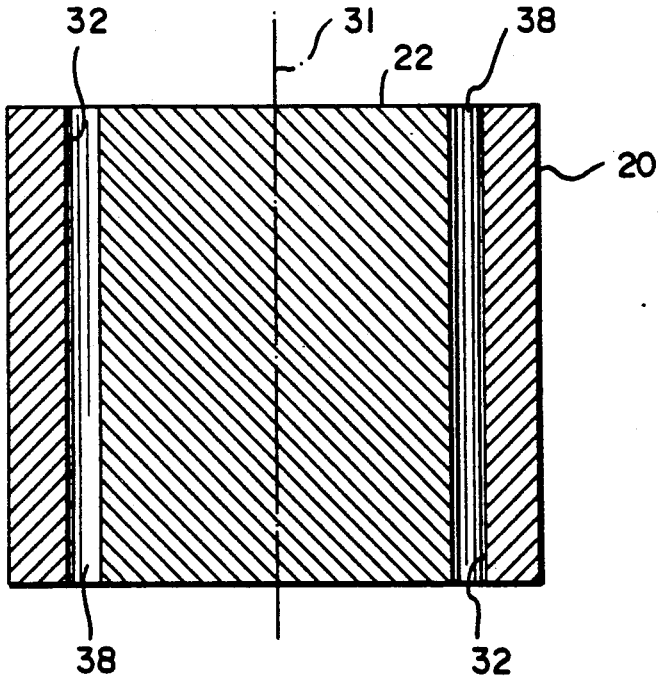
FIG. 4 is a section view along the 4—4 line of FIG. 5.
Figure 5:
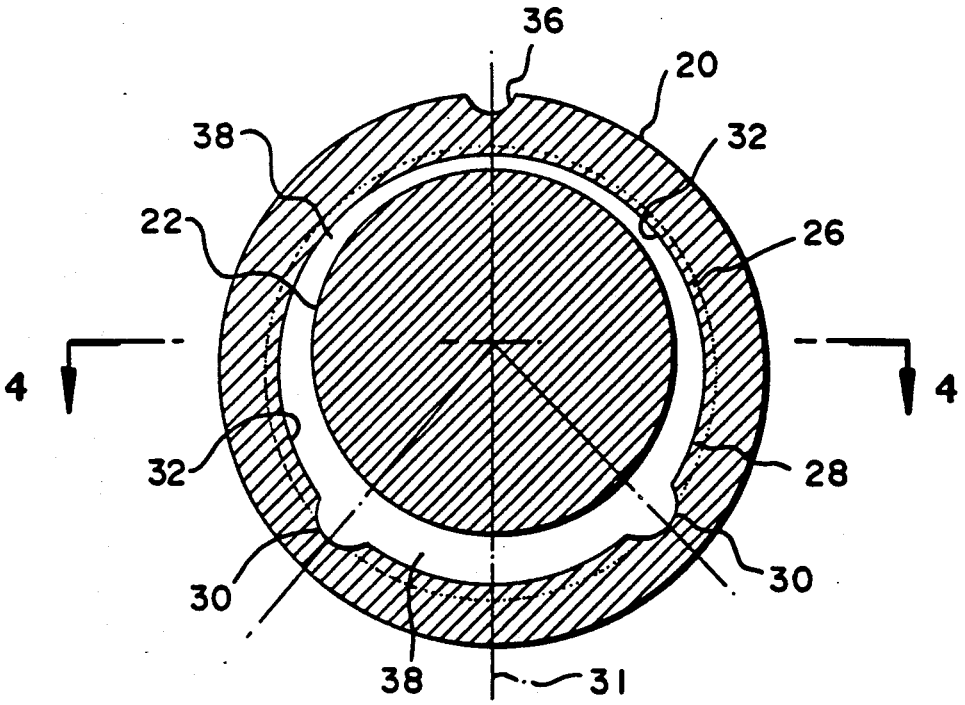
FIG. 5 is an elevation end view of the bearing and shaft assembly.

The preferred bearings 20, shown in FIGS. 4 and 5, are a cylindrically shaped, chemically inert, wear resistant plain ceramic bearing. The plain ceramic bearings provide ease of assembly of the pump 10 and are easier to clean than conventional steel bearings and, thus, can be reused. Moreover, the ceramic bearings are more wear resistant than steel used in conventional pumps. In the preferred embodiment, the ceramic material is sintered silicon carbide. However, other ceramics may be used such as silicon nitride, aluminum oxide, or zirconia. The interior wall 32 of bearings 20 (FIG. 5) forms a high stress zone 26 (denoted by shaded portion) and a low stress zone 28 (denoted by crosshatched portion) due to deflection caused by pressure in the gear intermesh 14. Maximum pressure is exerted on the interior wall 32 in the high stress zone 26 as highly viscous materials are transported by intermeshing gears 14 to the discharge end of pump body 14. Conversely, minimum pressure is exerted on the interior wall 32 in the low stress zone 28. Interior wall 32, moreover, has a groove or channel 30 or a plurality of spaced apart grooves or channels 30 along the wall length in the low stress zone 28 to provide a means for the working materials to enter inside bearings 20 so that a continuous hydrodynamic film is formed to lubricate bearings 20. Channels 30 also relieve particles from gear shafts 22,24. In the preferred embodiment, interior wall 32 has two symmetrically arranged channels 30 spaced 45° on either side of a centerline 31 drawn through both shafts 22,24 and diagonally opposite a portion of the high stress zone 26. Those skilled in the art would appreciate that one or more channels 30 can be arranged in other spaced relationships in the low stress zone 28 of bearings 20 with the same or similar effect. In operation, when high viscosity working material squeezes through intermeshing gears 14 (FIG. 7), the working materials exert an upward force on the intermeshing gears 14 which correspondingly exerts a force on the shafts 22,24 and bearings 20 in the high stress zone 26. This results in premature wear of shafts 22,24 and bearings 20 in prior art pumps. Channels 30, positioned in the low stress zone 28, provide additional working materials to high stress zone 26 as the materials are transported and act as a means of lubricating bearings 20 and shafts 22,24 thereby providing additional protection from premature wear. Also, a clearance 38 is formed between shafts 22,24 and bearings 20 by the working materials, i.e., the materials being pumped, in the high stress zone 26 and low stress zone 28 of bearings 20 as described hereinbelow.

Plain bearings 20 are press fitted in bearing receiving cavity 21 of side plates 16,18. Round metal pins 34 (shown in FIGS. 6 & 7) lock bearings 20 against rotation in the bearing receiving cavity 22 via pin receiving slot 36 (FIG. 5). Those skilled in the art will appreciate any suitable means of securing bearings 20 may be used, such as epoxy bonding, brazing, etc. Construction of bearings 20 is such that the clearance 38 (FIGS. 5 & 7) between shafts 22,24 supported in bearings 20 and bearings 20 is in the range from about 0.001 inches to about 0.010 inches during the operation of gear pump 10. A clearance between the shafts 22,24 and bearings 20 of 0.005 inches is preferred so that there is no contact between the shafts 22,24 and bearings 20 during operations. Moreover, the clearance 40 between the bearing receiving cavity 21 and the outside diameter of bearings 20 must be minimum, preferably in the range of 0.001 and 0.005 inches (FIG. 6). In accordance with the preferred embodiment of the invention, a clearance of 0.002 inches is preferred. Experiments indicate that a clearance in the above range minimizes undue radial movement of the bearings 20 during operations.

Furthermore, the service life of gear pump 10 is extended by wear resistant shafts 22,24 which rotate inside the ceramic plain bearings 20. Shafts 22,24 are rendered more wear resistant by applying hard coatings. Any known technique of hardening a surface may be employed, such as thermal spraying. Thermally sprayed tungsten carbide is the preferred hard coating technique. Hard coating shafts 22,24 also enables shafts 22,24 to be reused after applying new coatings. Further, shafts 22,24 are lubricated by pumped materials, as indicated above. Distortions in both shafts 22,24 and bearings 20 must be limited such that shafts 22,24 do not touch their respective bearings 20 at any point during operation. This is ensured by keeping the individual runout of shaft 22,24 and the bearings 20 to a minimum. Runout is measured by using any conventional means such as a dial indicator or feeler gage. The runout of bearings 20 surfaces on shaft 22,24 is in the range of 0.0001 inches to about 0.0005 inches. Good results have been obtained with a runout less than about 0.0005 inches. The cylindricity and runout of the inside diameter and outside diameter of bearings 20 are kept within 0.0001 inches to about 0.0005 inches.

FIG. 6 shows one of the side plates 16,18 constructed using either a hardened steel or steel coated with a wear resistant coating. The preferred wear resistant coating is a thermally sprayed tungsten carbide. Other coatings may be used, for example, thermally sprayed chrome oxide, aluminum oxide or titanium carbide. The surface 46 of side plates 16,18 is also coated with a hard coating such as tungsten carbide to increase the wear resistance. Surface 46 of side plates 16,18 also serves as a wear plate, thereby eliminating the need for a separate wear plate.

In the preferred embodiment of the invention, means for relieving pressure buildup in the intermesh of gears 14, i.e., the discharge side of centerline 31, are provided (FIGS. 6 & 7). A recess portion 50 having a substantially flat base (not shown) in side plates 16,18 is the preferred means of relieving pressure build-up in the intermesh of gears 14. Recess portion 50 may have any suitable size and shape within the general requirements of the invention, such as, circular, triangular, square, etc. Experiments conducted by inventors indicate that a substantially bell shaped recess portion 50 which extends from near the centerline 31 on the discharge side 17 of the intermesh of gears 14 beyond the point wherein the gears 14 are separated, i.e., beyond the point where there is no trapped working material (shown clearly in FIG. 7) is preferred and the most convenient to machine. Moreover, recess portion 50 has a depth in the range 0.060 inches to about 0.250 inches. The preferred depth of recess portion 50 is 0.125 inches. Recess portion 50 provides for reduction of the excessive pressure build-up in the intermesh of gears 14 on the discharge side as material is being pumped (direction denoted by arrows in FIG. 7) towards the discharge end of pump body 12 (FIG. 7). Thus, recess portion 50 diverts the material flow towards the discharge end of pump body 12 thereby resulting in reduced load on bearings 20 which helps maintain the running clearance between shafts 22,24 and the bearings 20. Secondarily, increased pressure at the discharge end of pump body 12 results from the diversion of pressure buildup in the intermesh of gears 14 toward the discharge end 17 of pump body 12.

The invention has thus been described in detail with particular reference to preferred embodiments thereof, but it will be understood that variations and modifications can be effected within the spirit and scope of the invention as described hereinabove and as defined in the appended claims.

What is claimed is:

1. A pump for materials having a viscosity up to about $3.0\times10^5$ centipoise (cps), said pump comprising:

a) a pump body formed with a gear receiving means, said pump body having an inlet end and a discharge end;

b) a pair of intermeshing gears arranged in said gear receiving means between said inlet end and said discharge end;

c) a pair of side plates having bearing receiving means, said side plates being mounted to said pump body to close said gear receiving means;

d) plain bearing means press fitted in the bearing receiving means;

e) a pair of shafts rotatably supported in said bearing means, said gears being mounted on said shafts and said shafts and said bearing means forming a bearing/shaft assembly; and, f) means formed in said side plates for relieving into the discharge end only the pressure build-up in the intermesh of said gears as said material is pumped towards the discharge end of said pump body to reduce the load on said bearing/shaft assembly.

2. The pump of claim 1 wherein the bearing means comprises a chemically inert, wear resistant ceramic material.

3. The pump of claim 1 wherein said side plates are coated with thermally sprayed tungsten carbide.

4. A pump for materials having a viscosity up to about $3.0\times10^5$ cps in the manufacture of photographic film base, said pump comprising:

a) a pump body formed with a gear receiving cavity, said pump body having an inlet end and a discharge end;

b) a pair of intermeshing gears arranged in said gear receiving cavity between said inlet end and said discharge end;

c) a pair of side plates having bearing receiving cavities, said side plates being mounted to said pump body to close said gear receiving cavity;

d) plain bearings press fitted in said bearing receiving cavity;

e) a pair of shafts rotatably supported in said bearing cavity, said gears being mounted on said shafts and said shafts and said plain bearing forming a bearing/shaft assembly; and, f) a recess portion formed in said side plates for relieving into the discharge end only the pressure build-up in the intermesh of said gears as material is pumped towards the discharge end of said pump body to reduce the load on said bearing/shaft assembly.

5. The pump of claim 4 wherein the plain bearing is a chemically inert, wear resistant ceramic material.

6. The pump of claim 4 wherein said plain bearing has a plurality of channels along the length of the interior portion for lubricating said gear shafts.

7. The pump of claim 4 wherein said gear shafts are coated with thermally sprayed tungsten carbide.

8. The pump of claim 4 wherein the clearance between said gear shaft rotatably supported in said bearing and said bearing is about 0.001 inches to about 0.010 inches.

9. The pump of claim 4 wherein said recess portion formed in said side plates for relieving pressure has a depth of about 0.060 inches to about 0.250 inches.

10. The pump of claim 4 wherein said side plates are coated with tungsten carbide.

* * * * *